US010758452B2

(12) United States Patent
Wersland et al.

(10) Patent No.: US 10,758,452 B2
(45) Date of Patent: Sep. 1, 2020

(54) MASSAGE ATTACHMENT ASSEMBLY WITH REMOVABLE CONTACT PORTION

(71) Applicant: Theragun, Inc., Beverly Hills, CA (US)

(72) Inventors: Jason Wersland, Manhattan Beach, CA (US); Benjamin Nazarian, Beverly Hills, CA (US); Jaime Sanchez Solana, Los Angeles, CA (US); Eduardo Merino, Beverly Hills, CA (US)

(73) Assignee: THREAGUN, INC., Beverly Hills, CA (US)

( * ) Notice: Subject to any disclaimer, the term of this patent is extended or adjusted under 35 U.S.C. 154(b) by 0 days.

(21) Appl. No.: 16/826,693

(22) Filed: Mar. 23, 2020

(65) Prior Publication Data

US 2020/0214930 A1 Jul. 9, 2020

Related U.S. Application Data

(63) Continuation-in-part of application No. 29/708,815, filed on Oct. 9, 2019, and a continuation-in-part of application No. 16/526,737, filed on Jul. 30, 2019, now Pat. No. 10,617,588, which is a continuation-in-part of application No. 16/027,008, filed on Jul. 3, 2018, now Pat. No. 10,470,970.

(60) Provisional application No. 62/648,810, filed on Mar. 27, 2018, provisional application No. 62/899,098, filed on Sep. 11, 2019.

(51) Int. Cl.
*A61H 23/00* (2006.01)

(52) U.S. Cl.
CPC ... *A61H 23/006* (2013.01); *A61H 2201/0107* (2013.01); *A61H 2201/0165* (2013.01); *A61H 2201/1669* (2013.01)

(58) Field of Classification Search
CPC ..... F16D 2001/062; F16F 9/3207; A61H 2201/1215; A61H 2201/168; A61H 2201/1664; A61H 2201/1685; A61H 23/006; A61H 15/00; A61H 15/0085; A61H 15/0078; Y10T 403/32704; Y10T 403/592
See application file for complete search history.

(56) References Cited

U.S. PATENT DOCUMENTS

| | | | |
|---|---|---|---|
| 2,391,671 | A | 12/1945 | Berg |
| 2,475,861 | A | 7/1949 | Thalmann |
| 3,172,675 | A | 3/1965 | Gonzalez |
| 4,596,406 | A | 6/1986 | Van Vleet |

(Continued)

OTHER PUBLICATIONS

International Search Report and Written Opinion for PCT/US2018/039599.

(Continued)

*Primary Examiner* — Daniel J Wiley
(74) *Attorney, Agent, or Firm* — Jeffer Mangels Butler & Mitchell LLP; Brennan C. Swain, Esq.

(57) ABSTRACT

A massage attachment assembly that includes a base portion having a proximal end and a distal end, and a contact portion having a proximal end and a distal end. The base portion includes an attachment member on the proximal end that is configured to secure the base portion to a percussive massage device. The proximal end of the contact portion is removably secured to the distal end of the base portion.

14 Claims, 6 Drawing Sheets

(56) References Cited

U.S. PATENT DOCUMENTS

| | | | | |
|---|---|---|---|---|
| 4,692,958 | A * | 9/1987 | McMakin | B24D 13/145 15/230 |
| 5,103,809 | A | 4/1992 | Deluca | |
| 5,123,139 | A * | 6/1992 | Leppert | B24D 13/147 15/230 |
| 5,201,149 | A * | 4/1993 | Eisenblatter | B24D 9/085 15/230.17 |
| 5,860,669 | A | 1/1999 | Wass | |
| 6,006,631 | A | 12/1999 | Miner | |
| 6,146,383 | A | 11/2000 | Studer | |
| 6,227,959 | B1 * | 5/2001 | Beaudry | B24D 15/023 451/490 |
| 6,228,120 | B1 | 5/2001 | Leonard | |
| 6,245,031 | B1 | 6/2001 | Pearson | |
| 6,537,236 | B2 | 3/2003 | Tucek | |
| 6,715,781 | B1 | 4/2004 | Smith | |
| 6,805,700 | B2 | 10/2004 | Miller | |
| 7,169,169 | B2 | 1/2007 | Tucek | |
| 7,497,639 | B2 | 3/2009 | Lebot | |
| 7,503,923 | B2 | 3/2009 | Miller | |
| 7,740,249 | B1 | 6/2010 | Gao | |
| 7,963,717 | B2 | 6/2011 | Seger | |
| 8,770,882 | B2 | 7/2014 | Ersoy | |
| 9,272,837 | B2 * | 3/2016 | Linzell | A61H 7/004 |
| 2005/0075591 | A1 | 4/2005 | Hafemann | |
| 2005/0131461 | A1 | 6/2005 | Tucek | |
| 2006/0272664 | A1 * | 12/2006 | O'Dwyer | A45D 29/14 132/73.6 |
| 2010/0210194 | A1 * | 8/2010 | Thomaschewski | B24B 23/03 451/357 |
| 2014/0101872 | A1 | 4/2014 | Utsch | |
| 2014/0163443 | A1 | 6/2014 | Young | |
| 2014/0288473 | A1 | 9/2014 | Matsushita | |
| 2015/0176674 | A1 | 6/2015 | Khan | |
| 2016/0324717 | A1 | 11/2016 | Burton | |

OTHER PUBLICATIONS

International Search Report and Written Opinion for PCT/US2018/040795.

* cited by examiner

MASSAGE ATTACHMENT ASSEMBLY WITH REMOVABLE CONTACT PORTION

CROSS REFERENCE TO RELATED APPLICATIONS

This application is a continuation-in-part of U.S. patent application Ser. No. 16/526,737, filed Jul. 30, 2019, which is a continuation-in-part of U.S. patent application Ser. No. 16/027,008, filed Jul. 3, 2018, now U.S. Pat. No. 10,470,970, which claims the benefit of U.S. Provisional Application No. 62/648,810, filed Mar. 27, 2018. This application also claims priority to U.S. Provisional Patent Application No. 62/899,098, filed Sep. 11, 2019, the entirety of which is incorporated by reference herein.

FIELD OF THE INVENTION

The present invention relates generally to a massage attachment for a percussive massage device, and more particularly to a massage attachment for a percussive massage device that includes a removable portion.

BACKGROUND OF THE INVENTION

Percussive massage devices often include interchangeable massage attachments or massage heads. Some massage attachments are made of a harder material than others. A need exists for a massage attachment that can be used on sensitive parts of a user's body.

SUMMARY OF THE PREFERRED EMBODIMENTS

In accordance with a first aspect of the present invention there is provided a massage attachment assembly that includes a base portion having a proximal end and a distal end, and a contact portion having a proximal end and a distal end. The base portion includes an attachment member on the proximal end that is configured to secure the base portion to a percussive massage device. The proximal end of the contact portion is removably secured to the distal end of the base portion. In a preferred embodiment, the proximal end of the contact portion includes a contact portion securing member and the distal end of the base portion includes a base portion securing member. The proximal end of the contact portion is removably secured to the distal end of the base portion by the contact portion and base portion securing members. Preferably, the contact portion and base portion securing members comprise a hook and loop material. In a preferred embodiment, the base portion securing member is a ring of hook and loop material that is received in an annular groove defined in the distal end of the base portion. In a preferred embodiment, the base portion comprises a harder material than the contact portion.

In accordance with another aspect of the present invention there is provided a kit that includes a massage attachment assembly, that includes a base portion and a first contact portion, and a second contact portion. The base portion includes a proximal end and a distal end. The base portion includes an attachment member on the proximal end that is configured to secure the base portion to a percussive massage device. The first contact portion includes a proximal end and a distal end and the proximal end of the first contact portion is configured to be removably secured to the distal end of the base portion. The second contact portion includes a proximal end and a distal end and the proximal end of the second contact portion is configured to be removably secured to the distal end of the base portion. In a preferred embodiment, the first contact portion and the second contact portion have a different shape. In another preferred embodiment, the first contact portion and second contact portion have the same shape, but the first contact portion and the second contact portion have a different softness (e.g., one is softer than the other). In another preferred embodiment, the first and second contact portions have different shapes and a different softness. In a preferred embodiment, the base portion comprises a harder material than both the first contact portion and the second contact portion.

In a preferred embodiment, the proximal end of the first contact portion includes a first contact portion securing member, the proximal end of the second contact portion includes a second contact portion securing member, and the distal end of the base portion includes a base portion securing member. The proximal end of the first contact portion is configured to be removably secured to the distal end of the base portion by the first contact portion and base portion securing members, and the proximal end of the second contact portion is configured to be removably secured to the distal end of the base portion by the second contact portion and base portion securing members. The kit can include more than two contact portions and can include more than one base member. The kit can also include the percussive massage device.

In accordance with another aspect of the present invention there is provided a method of using a percussive massage device that includes obtaining a massage attachment assembly that includes a base portion and a first contact portion removably secured together, attaching the massage attachment assembly to the percussive massage device, using the percussive massage device to massage a first body part with the first contact portion, removing the first contact portion from the base portion, attaching a second contact portion to the base portion, and using the percussive massage device to massage the first body part or a second body part with the second contact portion.

In a preferred embodiment, the present invention is a massage attachment assembly, massage element or treatment structure that is adapted to be connected to the male or female attachment on the end of the reciprocating shaft of a percussive massage device. In a preferred embodiment, the massage attachment assembly is configured to be used on sensitive areas of the body or on users that find other massage elements to hurt. Preferably, the massage attachment assembly includes two portions that can be separated from one another, the first portion that includes the connector or attachment assembly for connecting to the percussive massage device (e.g., see the female connector taught in U.S. Patent No. 2019/0017528, the entirety of which is incorporated herein by reference) and the second portion that contacts the user's body. The first and second portions are connected to one another by an attachment mechanism, such as VELCRO®. The first portion is preferably made of a very soft material that absorbs much of the impact. A spring can also be included to absorb the impact. In a preferred embodiment, the first portion is made of a polyurethane foam and the second portion is made of a softer material (e.g., EVA foam and/or NR-SBR combination foam) than the first portion (e.g., polyurethane).

In another embodiment, multiple contact portions can be provided that each include a different hardness (or softness) or that include a different shape. This provides the ability for interchangeable contact portions that can be used with a single base portion. For example, a kit can be provided or sold that includes a single base portion together with multiple contact portions. The contact portions can all be the same (e.g., when the first wears out or gets dirty a second one can be used) or include different shapes (e.g., different shapes for different areas of the body), different densities/softness/porosity (e.g., different softness for different areas of the body), different texture (e.g., different texture for a different feeling on the user's skin). In a preferred embodiment, the massage attachment assembly with the soft contact portion(s) can be used on a user's face to treat aging, wrinkles, etc. Many different shapes or designs for the massage attachment assembly and its individual components are within the scope of the invention and those discussed or shown herein are not intended to be limiting and are not the only shapes or designs that can be utilized.

Indentation force-deflection (IFD) is a process used in the flexible foam manufacturing industry to assess the "softness" of a sample of foam such as memory foam. To conduct an IFD test, a circular flat indenter with a surface area of 323 square centimeters (50 sq. inches-8" in diameter) is pressed against a foam sample usually 100 mm thick and with an area of 500 mm by 500 mm (ASTM standard D3574). The foam sample is first placed on a flat table perforated with holes to allow the passage of air. It is then "warmed up" by being compressed twice to 75% "strain", and then allowed to recover for six minutes. The force is measured 60 seconds after achieving 25% indentation with the indenter. Lower scores correspond with less firmness; higher scores with greater firmness. US measurements are given in pounds-force, and European ones are given in newtons. In a preferred embodiment, the contact portion has a lower IFD value than the base portion. In an embodiment with more than one contact portions, the first and second contact portions may have different IFD values.

BRIEF DESCRIPTION OF THE DRAWINGS

Like numerals refer to like parts throughout the several views of the drawings.

DETAILED DESCRIPTION OF THE PREFERRED EMBODIMENTS

Figure 1:
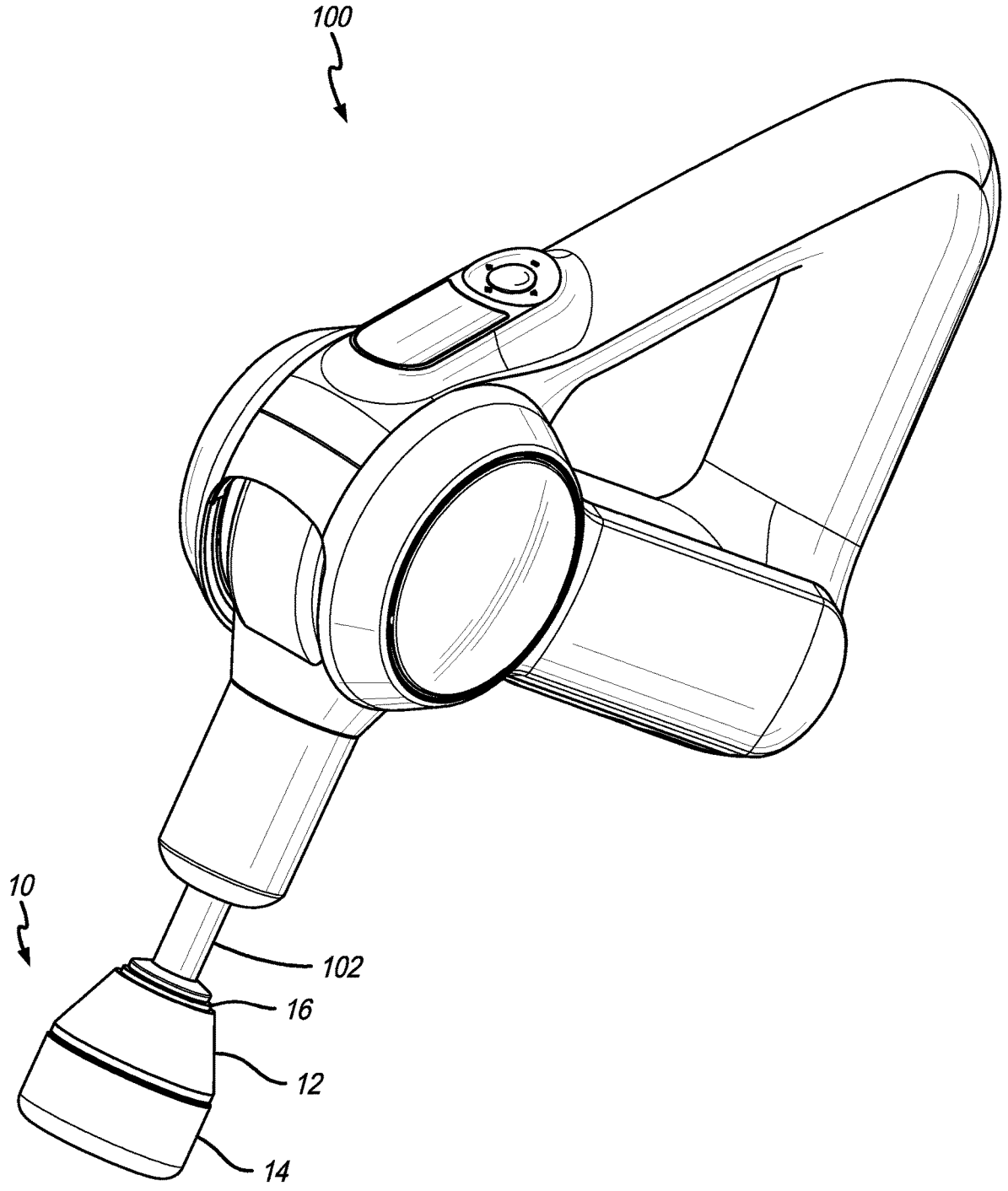
FIG. 1 is a perspective view of a percussive massage device with a massage attachment assembly in accordance with a preferred embodiment of the present invention attached thereto.

The following description and drawings are illustrative and are not to be construed as limiting. Numerous specific details are described to provide a thorough understanding of the disclosure. However, in certain instances, well-known or conventional details are not described in order to avoid obscuring the description. References to one or an embodiment in the present disclosure can be, but not necessarily are references to the same embodiment; and, such references mean at least one of the embodiments.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks: The use of highlighting has no influence on the scope and meaning of a term; the scope and meaning of a term is the same, in the same context, whether or not it is highlighted.

It will be appreciated that the same thing can be said in more than one way.

Consequently, alternative language and synonyms may be used for any one or more of the terms discussed herein. No special significance is to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

Without intent to further limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions, will control.

It will be appreciated that terms such as "front," "back," "top," "bottom," "side," "short," "long," "up," "down," "aft," "forward," "inboard," "outboard" and "below" used herein are merely for ease of description and refer to the orientation of the components as shown in the figures. It should be understood that any orientation of the components described herein is within the scope of the present invention.

Referring now to the drawings, wherein the showings are for purposes of illustrating the present invention and not for purposes of limiting the same, FIGS. 1-6 show embodiments of massage attachment assemblies 10 for use with a percussive massage device 100 in accordance with a preferred embodiment of the present invention.

Figure 2:
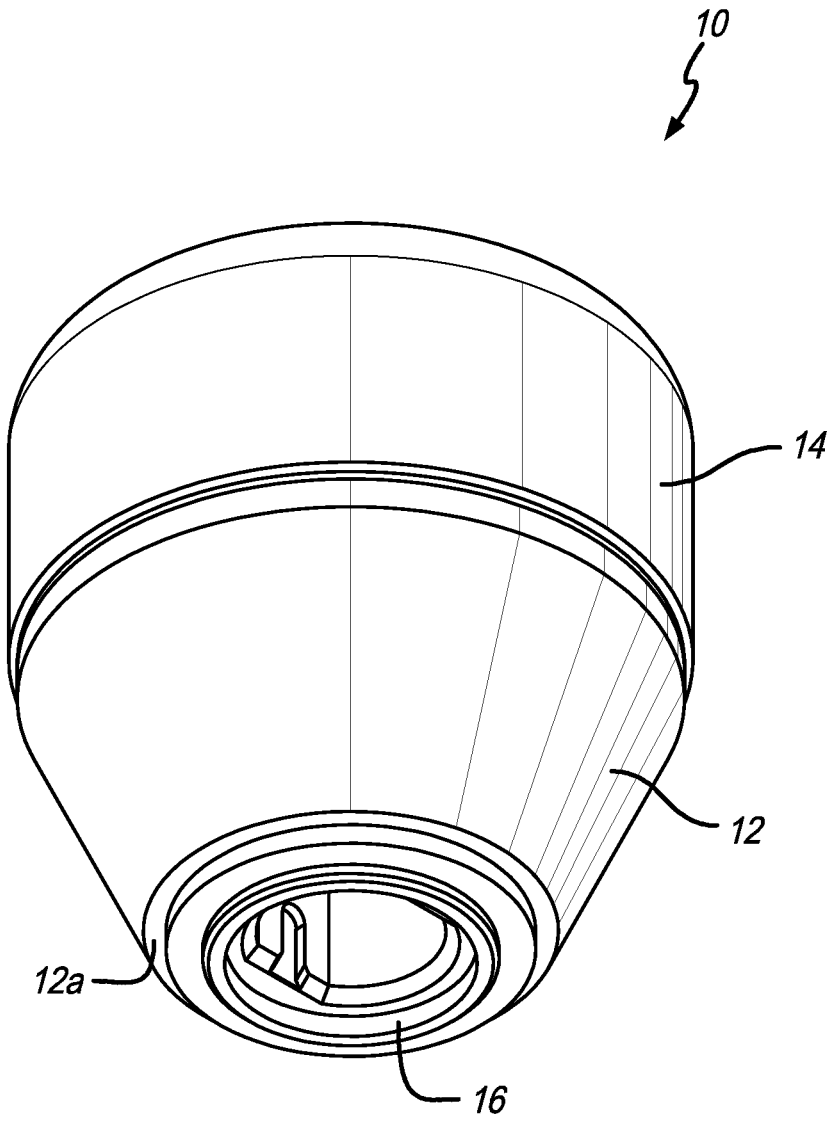
FIG. 2 is a bottom perspective view of the massage attachment assembly of FIG. 1.
Figure 3:
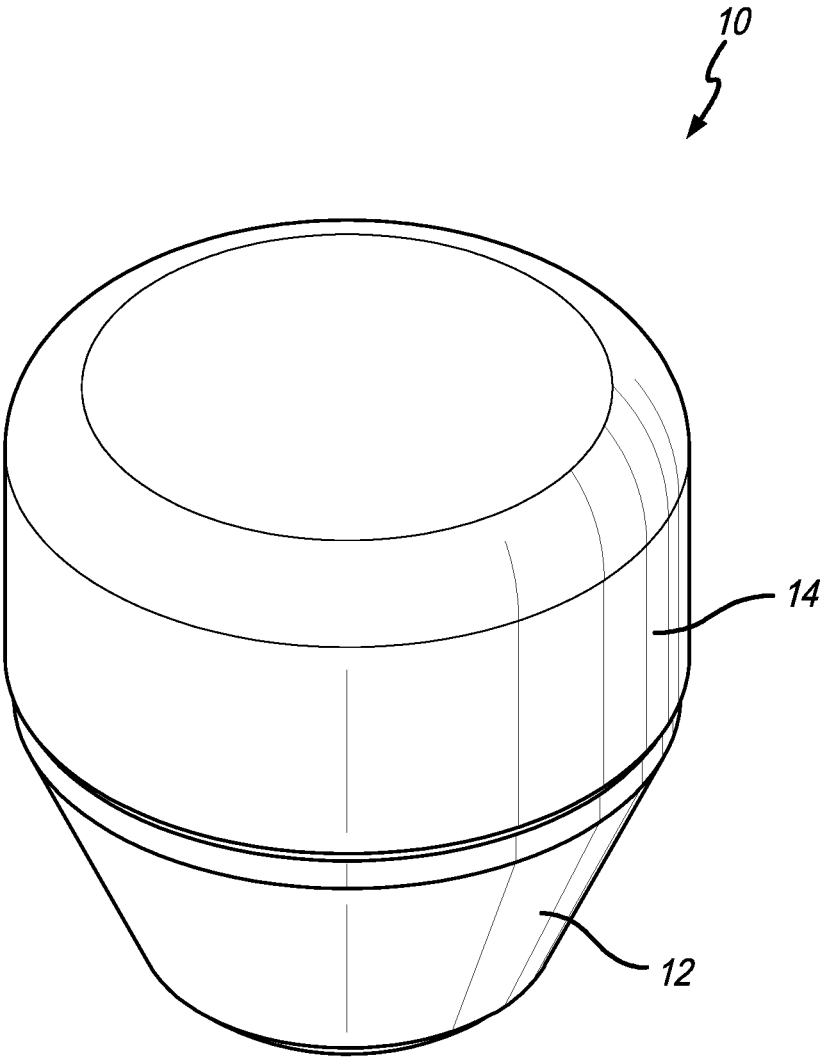
FIG. 3 is a top perspective view of the massage attachment assembly of FIG. 1.
Figure 4:
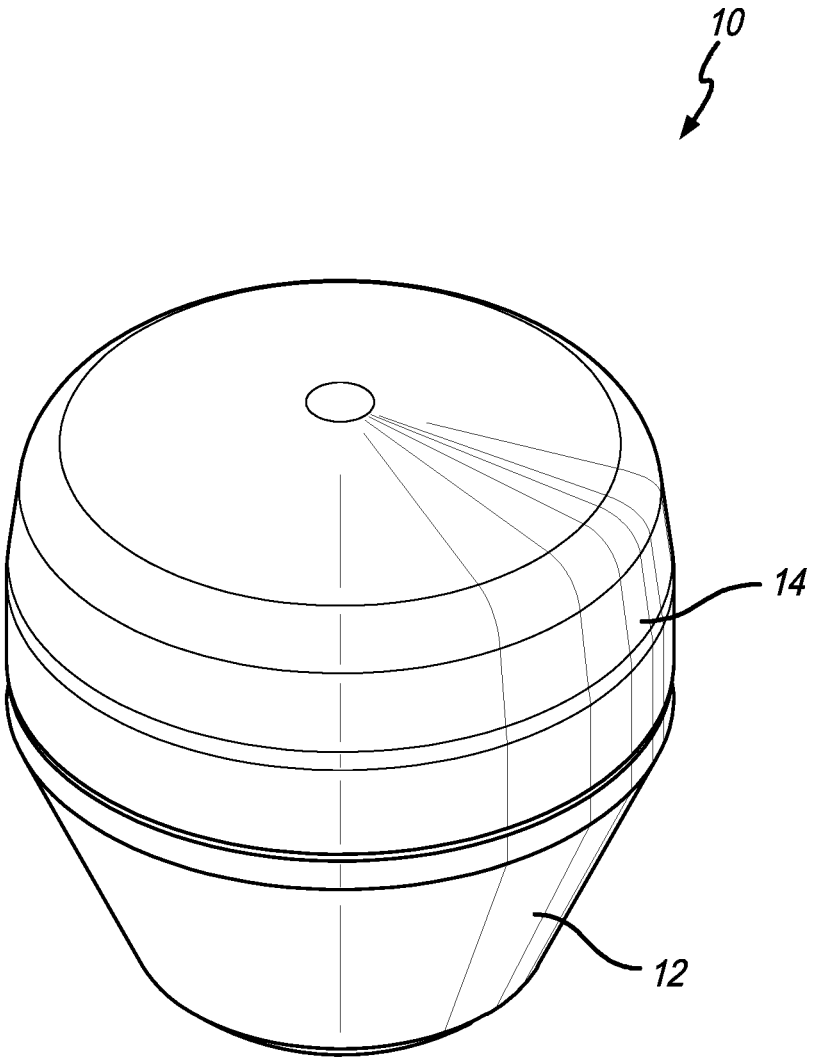
FIG. 4 is a top perspective view of another massage attachment assembly.

In a preferred embodiment, the massage attachment assembly 10 generally includes a base portion 12 and a contact portion 14 that is removably attached to the base portion 12. As shown in FIGS. 1-2, the base portion 12 includes an attachment member 16 on or in the proximal end 12*a* for securing the base portion 12 to the reciprocating shaft 102 of the percussive massage device 100. The drawings show a female attachment member or recess. However, this is not a limitation on the present invention and the base portion 12 can be modified to include a male attachment member (to connect to a female attachment member on the shaft of a reciprocating treatment device) or any other system for connecting massage attachments or treatment members to a percussive massage device. FIG. 4 shows a massage attachment assembly 10 with a contact portion 14 having a different shape (a rounded, as opposed to a flat, distal end or surface) than that shown in FIG. 3. In a preferred embodiment, the base portion 12 and the contact portion 14 are configured to be in axial alignment when secured to one another (of course, when Velcro is used, they may be slightly out of axial alignment).

Figure 5:
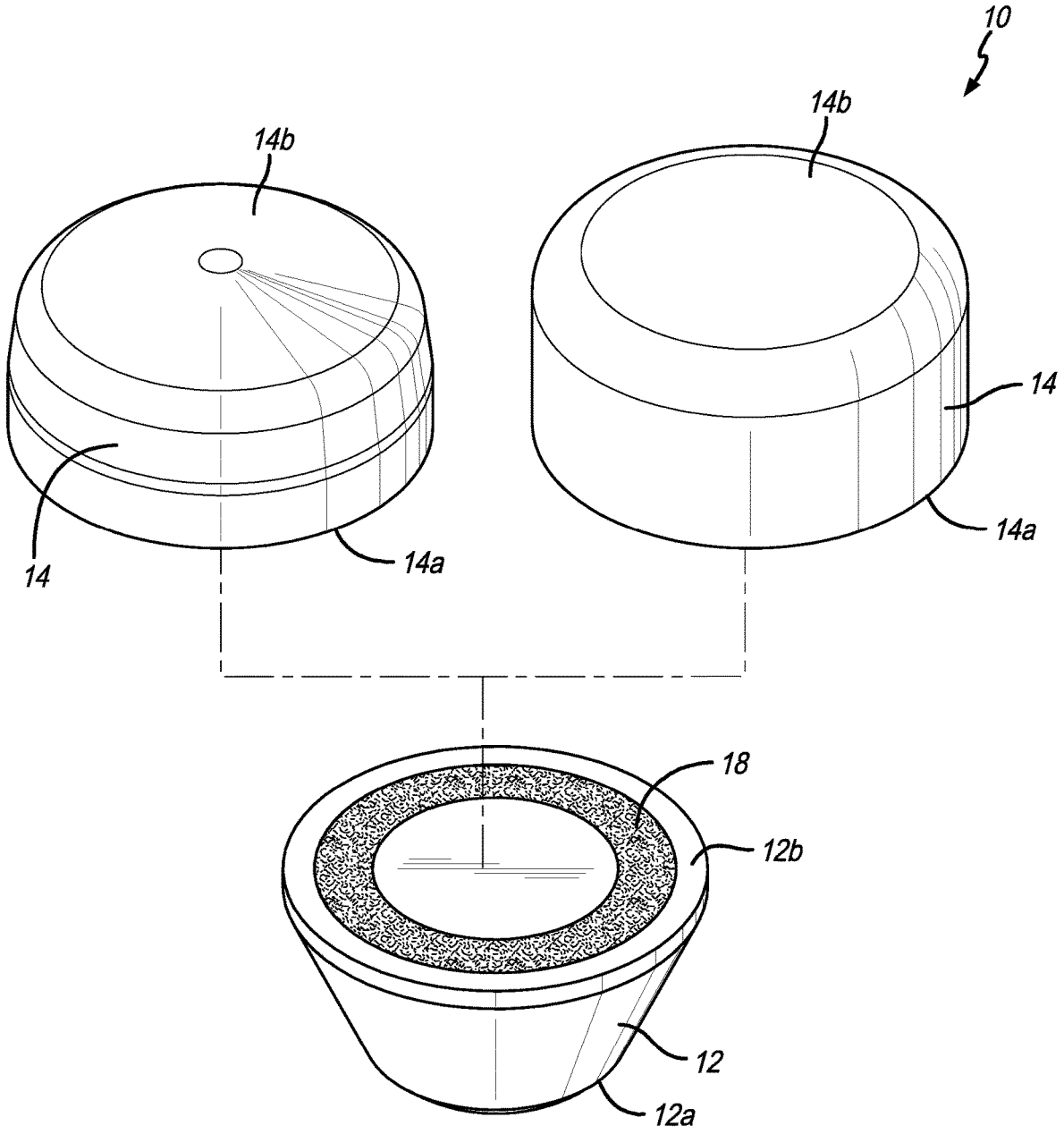
FIG. 5 is a perspective view of the massage attachment assembly with the contact portions of FIGS. 1 and 4 separated from the base portion.
Figure 6:
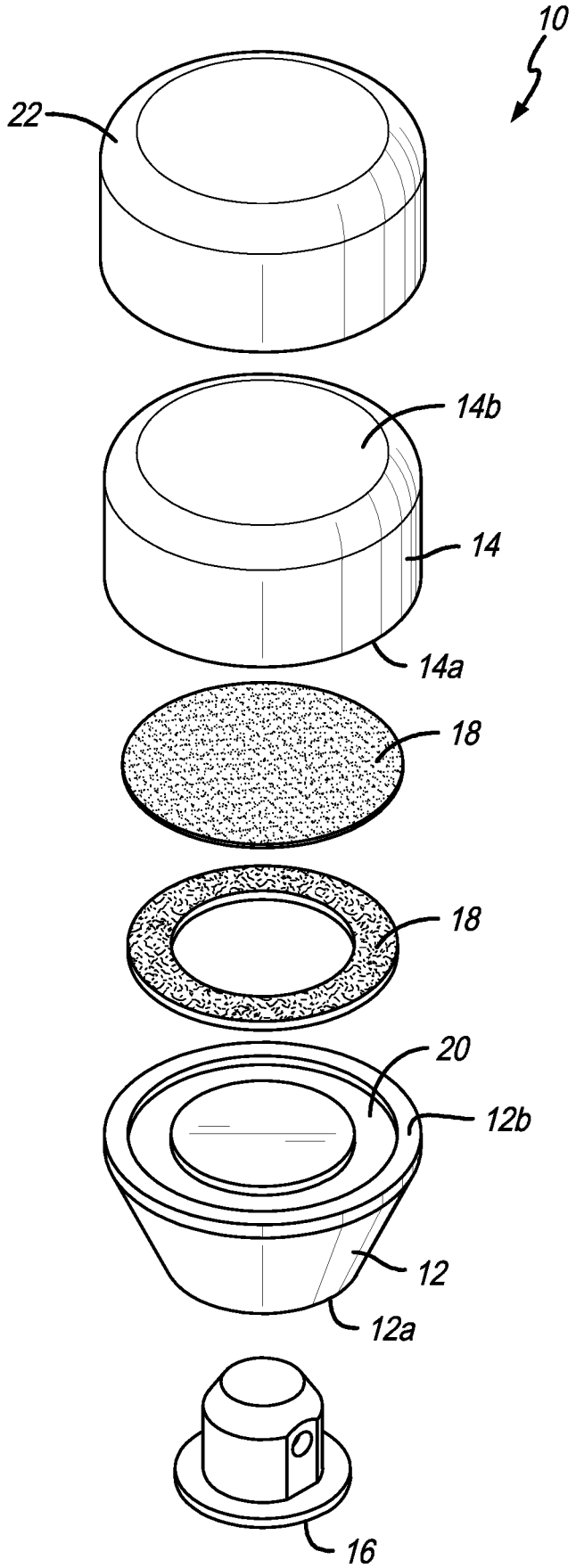
FIG. 6 is an exploded perspective view of the massage attachment assembly of FIG. 1 with a cover.

As shown in FIG. 5, in a preferred embodiment, the contact portion 14 can be separated from the base portion 12. FIG. 5 shows the contact portions 14 from the two different shaped massage attachment assemblies 10 in FIGS. 3 and 4. This shows that the two contact portions 14 are interchangeable. The base and contact (or first and second) portions 12 and 14 are connected to one another by complementary base portion and contact portion securing members 18. For example, as shown in FIGS. 4-6, the base and contact portions 12 and 14 include hook and loop material or VELCRO® thereon so that the contact portion 14 can be separated from the base portion 12 without disconnecting the base portion 12 (and the attachment member 16) from the percussive massage device 100. The base portion and contact portion securing members 18 can include or comprise other attachment or securement mechanisms, such as a snap fit, friction fit, press fit, snaps, buttons, threads, magnets, ring(s) that are received in annular groove(s), stitching, glue, temporary or permanent adhesive, welding and the like.

In a preferred embodiment, the base portion 12 includes a proximal end 12*a* (closest to the percussive massage device 100) and a distal end 12*b* and the securing member 18 is positioned on the distal end 12*b*. The contact portion 14 includes a proximal end 14*a* and a distal end 14*b* and the contact portion securing member 18 is positioned on the proximal end 14*a*. As shown in FIG. 6, the base portion securing member 18 can be a ring of hook and loop material that is received in an annular groove 20 on the base portion 12 and the contact portion securing member 18 can be a disc of hook and loop material that is connected to the contact portion 14.

As shown in FIG. 6, in a preferred embodiment, the contact portion 14 can include a cover 22 that is used to cover and protect the contact portion 14 prior to use (e.g., during shipping or otherwise prior to purchase or use). The cover 22 protects the contact portion 14 from being damaged or deformed prior to use. The cover 22 is removed prior to use with the percussive massage device. In another embodiment, the cover can be omitted. The cover 22 can also be left on the contact portion 14 and made of a material that prevents or limits liquids (e.g., a user's sweat) from being absorbed into the material of the contact portion 14.

The contact portion 14 (the soft portion 24 thereof if a cover is included) is preferably made of a very soft material that absorbs much of the impact and the base portion 12 is made of a harder or more rigid material than the contact portion 14. It will be appreciated that the contact portion 14 is made of a soft material so that it can be used on sensitive areas of a user's body. However, the material of the contact portion 14 may be too soft to support the connection between the attachment member 16 and the percussive massage device. Therefore, it will be appreciated that the base portion 12 is made of a more rigid material (than the material of the contact portion 14) so that the base portion 12 can be connected or attached to the percussive massage device. This allows the more rigid base portion 12 to connect to the percussive massage device 100 and the softer contact portion 14 to connect to the base portion 12. For example, in a preferred embodiment, the base portion 12 is made of a polyurethane (PU) foam, polyurethane rubber or another plastic or rubber. In a preferred embodiment, the contact portion is made of an ethylene-vinyl acetate (EVA) foam or other soft material. It should be appreciated that the base portion 12 is made of a material that has a higher density and/or higher porosity (to provide rigidity for connection to the percussive massage device, as described above) than the material of the contact portion 14 (so the contact portion can absorb much of the impact).

In another embodiment, multiple contact portions 14 can be provided that each include a different hardness (or softness) or that include a different shape (as is shown in FIG. 5). This provides the ability for interchangeable contact portions. For example, a kit can be provided or sold that includes a single base portion together with multiple contact portions. The contact portions can all be the same or include different shapes, different densities, different softness, different texture. In another embodiment, the contact portion 14 can be permanently connected to the base portion 12.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description of the Preferred Embodiments using the singular or plural number may also include the plural or singular number respectively. The word "or" in reference to a list of two or more items, covers all of the following interpretations of the word: any of the items in the list, all of the items in the list, and any combination of the items in the list.

The above-detailed description of embodiments of the disclosure is not intended to be exhaustive or to limit the teachings to the precise form disclosed above. While specific embodiments of and examples for the disclosure are described above for illustrative purposes, various equivalent modifications are possible within the scope of the disclosure, as those skilled in the relevant art will recognize. Further, any specific numbers or dimensions noted herein are only examples: alternative implementations may employ differing values, measurements, dimensions or ranges.

The teachings of the disclosure provided herein can be applied to other systems, not necessarily the system described above. The elements and acts of the various embodiments described above can be combined to provide further embodiments. Any measurements described or used herein are merely exemplary and not a limitation on the present invention. Other measurements can be used. Further, any specific materials noted herein are only examples: alternative implementations may employ differing materials.

Any patents and applications and other references noted above, including any that may be listed in accompanying filing papers, are incorporated herein by reference in their entirety. Aspects of the disclosure can be modified, if necessary, to employ the systems, functions, and concepts of the various references described above to provide yet further embodiments of the disclosure.

These and other changes can be made to the disclosure in light of the above Detailed Description of the Preferred Embodiments. While the above description describes certain embodiments of the disclosure, and describes the best mode contemplated, no matter how detailed the above appears in text, the teachings can be practiced in many ways. Details of the system may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features or aspects of the disclosure with which that terminology is associated. In general, the terms used in the following claims should not be construed to limit the disclosures to the specific embodiments disclosed in the specification unless the above Detailed Description of the Preferred Embodiments section explicitly defines such terms. Accordingly, the actual scope of the disclosure encompasses not only the disclosed embodiments, but also all equivalent ways of practicing or implementing the disclosure under the claims.

Accordingly, although exemplary embodiments of the invention have been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A massage attachment assembly comprising:

a base portion that includes a proximal end and a distal end, wherein the base portion includes an attachment member on the proximal end, wherein the attachment member is configured to secure the base portion to a percussive massage device, and wherein the distal end of the base portion includes a base portion securing member, a contact portion that includes a proximal end and a distal end, wherein the proximal end of the contact portion includes a contact portion securing member, wherein the proximal end of the contact portion is removably secured to the distal end of the base portion by the contact portion and base portion securing members, and wherein the contact portion and base portion securing members comprise a hook and loop material.

2. The massage attachment assembly of claim 1 wherein the base portion securing member is a ring of hook and loop material that is received in an annular groove defined in the distal end of the base portion.

3. The massage attachment assembly of claim 1 wherein the hook and loop material is generally flat.

4. A massage attachment assembly comprising:

a base portion that includes a proximal end and a distal end, wherein the base portion includes an attachment member on the proximal end, wherein the attachment member is configured to secure the base portion to a percussive massage device, wherein the base portion comprises a polyurethane foam, polyurethane rubber or other plastic or rubber, a contact portion that includes a proximal end and a distal end, wherein the proximal end of the contact portion is removably secured to the distal end of the base portion, wherein the contact portion comprises an ethylene-vinyl acetate foam or a natural rubber-styrene-butadiene combination foam.

5. The massage attachment assembly of claim 4 wherein the contact portion and base portion securing members comprise a hook and loop material.

6. The massage attachment assembly of claim 4 wherein the base portion comprises a polyurethane foam having a first indentation force-deflection value, wherein the ethylene-vinyl acetate foam or natural rubber-styrene-butadiene combination foam of the contact portion has a second indentation force-deflection value, and wherein the second indentation force-deflection value is less than the first indentation force-deflection value.

7. A kit comprising:

a massage attachment assembly that includes a base portion and a first contact portion, wherein the base portion includes a proximal end and a distal end, wherein the base portion includes an attachment member on the proximal end that is configured to secure the base portion to a percussive massage device, wherein the distal end of the base portion includes a base portion securing member, wherein the first contact portion includes a proximal end and a distal end, wherein the proximal end of the first contact portion includes a first contact portion securing member, wherein the proximal end of the first contact portion is configured to be removably secured to the distal end of the base portion by the first contact portion and base portion securing members, and wherein the first contact portion and base portion securing members comprise a hook and loop material, and a second contact portion that includes a proximal end and a distal end, wherein the proximal end of the second contact portion includes a second contact portion securing member, wherein the proximal end of the second contact portion is configured to be removably secured to the distal end of the base portion by the second contact portion and base portion securing members, and wherein the second contact portion and base portion securing members comprise a hook and loop material.

8. The kit of claim 7 wherein the first contact portion and the second contact portion have a different shape.

9. The kit of claim 7 wherein the first contact portion and second contact portion have the same shape, and wherein the first contact portion and the second contact portion have a different softness.

10. The kit of claim 9 wherein the base portion comprises a harder material than both the first contact portion and the second contact portion.

11. A method of using a percussive massage device, the method comprising the steps of:

obtaining a massage attachment assembly that includes a base portion and a first contact portion removably secured together by a base portion securing member and a first contact portion member that are comprised of hook and loop material, attaching the massage attachment assembly to the percussive massage device, using the percussive massage device to massage a first body part with the first contact portion, removing the first contact portion from the base, attaching a second contact portion to the base portion, wherein the second contact portion includes a second contact member that comprises hook and loop material, and using the percussive massage device to massage the first body part or a second body part with the second contact portion.

12. The method of claim 11 wherein the first contact portion and the second contact portion have a different shape.

13. The method of claim 12 wherein the base portion comprises a harder material than both the first contact portion and the second contact portion.

14. The method of claim 11 wherein the first contact portion and second contact portion have the same shape, and wherein the first contact portion and the second contact portion have a different softness.

* * * * *